United States Patent [19]

Tokashiki

[11] 4,050,433

[45] Sept. 27, 1977

[54] LIQUID FUEL PUMPING APPARATUS

[75] Inventor: Kanenobu Tokashiki, Kanagawa, Japan

[73] Assignee: Lucas Industries Limited, Birmingham, England

[21] Appl. No.: 640,858

[22] Filed: Dec. 15, 1975

[30] Foreign Application Priority Data

Oct. 22, 1975 United Kingdom ..... 43282/75

[51] Int. Cl.[2] ..... F02M 39/00

[52] U.S. Cl. ..... 123/139 AQ; 123/140 FG

[58] Field of Search ..... 123/139 AQ, 140 FG

[56] References Cited

U.S. PATENT DOCUMENTS

| | | | |
|---|---|---|---|
| 2,916,029 | 12/1959 | Kemp | 123/139 AQ |
| 3,943,902 | 3/1976 | Skinner | 123/139 AQ |

*Primary Examiner*—Alan Cohan
*Assistant Examiner*—Gerald R. Michalsky
*Attorney, Agent, or Firm*—Holman & Stern

[57] ABSTRACT

A fuel pump for supplying fuel to an internal combustion engine includes a cam ring movable angularly to determine the timing of injection of fuel. The cam ring is moved by a piston against the action of resilient means by fluid under pressure from the outlet of a feed pump the output pressure of which varies in accordance with the speed at which the apparatus is driven. A second piston is provided and this is moved by the aforesaid fluid pressure against the action of further resilient means in a direction away from the first mentioned piston. The second mentioned piston is subjected to a fluid pressure assisting the action of the further resilient means, the second fluid pressure depending upon the amount of fuel which is being supplied to the engine.

6 Claims, 2 Drawing Figures

LIQUID FUEL PUMPING APPARATUS

BACKGROUND OF THE INVENTION

This invention relates to liquid fuel pumping apparatus for supplying fuel to an internal combustion engine and of the kind comprising an injection pump drivable in timed relationship with the associated engine, a feed pump for supplying fuel under pressure to the injection pump at a pressure which varies in accordance with the speed at which the apparatus is driven, a throttle member for controlling the quantity of fuel supplied to the injection pump and thereby controlling the quantity of fuel supplied to the associated engine and fluid pressure operable means for controlling the timing of delivery of fuel by the injection pump.

SUMMARY OF THE INVENTION

The object of the invention is to provide an apparatus of the kind specified in which said fluid pressure operable means is responsive to the amount of fuel supplied to the engine.

According to the invention in an apparatus of the kind specified said fluid pressure operable means comprises a first piston slidable within a cylinder, means coupling said first piston to a component of the injection pump whereby movement of said piston will alter the timing of delivery of fuel by the injection pump, first resilient means biasing said first piston towards one end of the cylinder, conduit means through which the pressure of fuel delivered by said feed pump can be applied to said first piston to move said first piston against the action of the resilient means and in a direction to advance the timing of delivery of fuel, a second piston housed within a further cylinder, second resilient means urging said second piston in the direction to engage said first piston to assist the action of fuel pressure acting on the first piston, said fuel pressure also acting on one side of said second piston to oppose the force exerted by the second resilient means, a further conduit through which a control pressure can be applied to the other-side of said second piston and valve means operable in conjunction with said throttle means for generating said control pressure, said valve means being arranged so that said control pressure is substantially equal to the output pressure of the feed pump when said throttle means is set to provide a low quantity of fuel and is substantially zero when the throttle means is set to provide a high quantity of fuel.

According to a further feature of the invention said first resilient means exerts a higher force on said first piston than said second resilient means exerts on said second piston.

DESCRIPTION OF THE DRAWINGS

One example of a fuel injection pumping apparatus in accordance with the invention will now be described with reference to the accompanying drawings in which.

DESCRIPTION OF PREFERRED EMBODIMENTS

Figure 1:
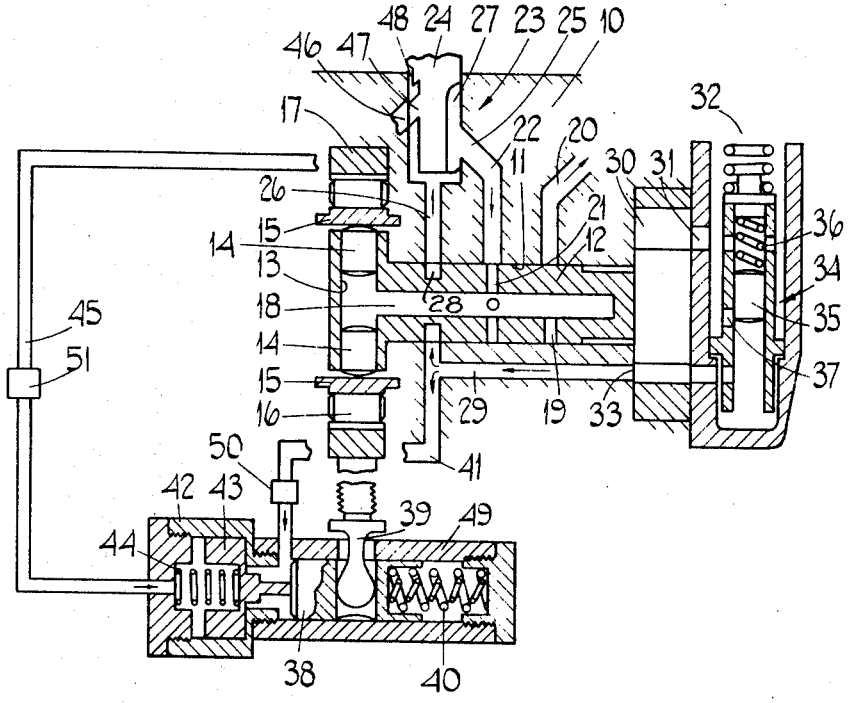
FIG. 1 is a diagrammatic side elevation of the apparatus.

With reference to FIG. 1 of the drawings the apparatus comprises a body part 10 in which is formed a cylindrical bore 11 housing a rotary cylindrical distributor member 12. The distributor member 12 in use is arranged to be driven in timed relationship with the associated engine and at one end of the distributor member there is provided an enlarged portion in which is formed a transversely extending bore 13.

The bore 13 accomodates a pair of pumping plungers 14 which at their outer ends, can be engaged by shoes 15 respectively which carry rollers 16.

The rollers 16 are engageable with the internal periphery of an annular cam ring 17 which is supported for angular movement within the body part 10. The cam ring is provided on its internal periphery, with a plurality of pairs of cam lobes whereby as the distributor member rotates, inward movement will be imparted to the rollers to displace fuel from the bore 13.

The bore 13 is in communication with an axially extending passage 18 in the distributor member and this passage communicates with a delivery passage 19 which extends outwardly to the periphery of the distributor member and which during inward movement of the plungers 14, registers with one of a plurality of outlet ports 20 formed in the body part 10. The outlet ports in use, are connected to the injection nozzles respectively of the associated engine.

The passage 18 also communicates with a plurality of outwardly extending inlet passages 21 and these can register inturn, with an inlet port 22 formed in the body part 10. One of the inlet passages 21 registers with the port 22 during the time when the delivery passage 19 is out of register with the outlet ports.

Fuel is supplied to the inlet port 22 by way of throttle means 23 and in the particular example the throttle means comprises a cylindrical member 24 which is angularly movable to determine the quantity of fuel which is supplied to the injection pump the latter being constituted by the plungers 14 and the cam lobes on the cam ring 17.

The valve member 24 is angularly movable within a bore formed in the body part and the inlet port 22 communicates with a port 25 which opens into the bore. One end of the bore communicates with the outlet of a feed pump by way of a passage 26 and formed on the valve member 24 is an axially extending groove 27 which is in constant communication with the passage 26. As the valve member 24 is moved angularly the degree of registration of the groove 27 with the port 25 will vary and thereby an adjustable throttle is created. The passage 26 communicates with a groove 28 formed on the periphery of the distributor member and this groove communicates with the passage 29 formed in the body part and communicating with the outlet of the feed pump which is indicated at 30. The feed pump conveniently is of the rotary vane type and has an inlet 31 which communicates with a fuel inlet 32 which in use is connected to a source of fuel. The outlet of the feed pump is indicated at 33 and a valve 34 is provided so that the outlet pressure of the feed pump varies in accordance with the speed at which the apparatus is driven. The valve 34 is of a well known type in which a plunger 35 which is subjected to the outlet pressure of the feed pump moves against the action of a spring 36 with increasing fuel pressure to open a spill port 37 communicating with the inlet 31 of the feed pump.

In operation, when the plungers are permitted to move outwardly by the cam lobes fuel passes through the inlet port 22 into the bore 13 and the plungers are moved outwardly by the fuel pressure. The extent of outward movement is determined by the angular setting of the valve member 24. During continued rotation of the distributor member, the inlet passage 21 is moved out of register with the inlet port 22 and the delivery passage 19 is moved into register with one of the outlet ports 20. When such communication is established, inward movement of the plungers 14 by the action of the cam lobes delivers fuel to the appropriate injection nozzle of the engine.

It is desirable to be able to adjust the timing of the delivery of fuel by the injection pump in accordance with the speed at which the apparatus is driven and for this purpose a first piston 38 is provided which is coupled to the annular cam ring 17 by means of a peg 39. The piston 38 is loaded in one direction by means of a pair of coiled compression springs 40 and the outlet pressure of the feed pump is applied to an end of the piston 38 by way of a conduit 41. With this arrangement as the speed of operation of the associated engine increases thereby resulting in an increase in the outlet pressure of the feed pump, the piston 38 will be moved against the action of the springs 40 in a direction to advance the timing of delivery of fuel. It should be noted that in FIG. 1 the direction of movement of the piston 38 is shown to be parallel to the axis of the distributor member, in practice the direction of movement of the piston 38 is at right angles to the axis of the distributor member so that angular movement about the axis of the distributor member is imparted to the cam ring 17.

The piston 38 is located within a cylinder formed in a housing 49 which is secured to the body part 10. An extended portion 42 of the housing defines a further cylinder for a second piston 43. The piston 43 is provided with an extension for engagement with the piston 38 and is loaded towards the piston 38 by means of a second resilient means in the form of a coiled compression spring 44. The conduit 41 communicates with the space between the two pistons and therefore the piston 43 on one side is subjected to the outlet pressure of the feed pump.

On its other side the piston 43 is subjected to a control pressure by way of a conduit 45. The conduit 45 communicates with a further port 46 formed in the wall of the cylinder accomodating the valve member 24 and the valve member 24 is provided with a helically disposed land 47 having a smaller axial width than the port 46. The space on the one side of the land 47 is exposed to the pressure within the passage 26 and the space on the otherside of the land is exposed to a drain pressure which is substantially zero, by way of a groove 48 formed in the periphery of the valve member. Conveniently the drain is connected to the inlet 31 of the feed pump by way of passages not shown.

In operation, when the valve member is set to provide the maximum quantity of fuel the pressure in the port 46 and thereby in the conduit 45 is the drain pressure and when the valve member is set to provide low quantities of fuel the pressure in the port 46 is substantially equal to the outlet pressure of the feed pump. Because the land 47 has a smaller axial width than the port 46 the pressure will vary depending upon the setting of the valve member.

The force exerted by the springs 40 is higher than the force exerted by the spring 44 and when the pressure in the conduit 45 is equal to drain pressure, the piston 43 will be moved away from the piston 38 by the pressure developed at the outlet of the feed pump. The piston 43 therefore will play no part in determining the timing of delivery of fuel by the engine and the piston 38 will move against the action of the spring 40 as the fuel pressure increases. In the graph this condition is indicated by the dotted line and it will been seen that as the speed increases so the degree of advance increases.

Figure 2:
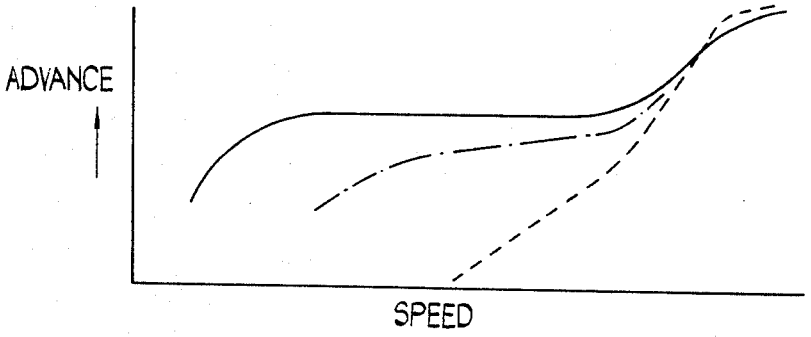
FIG. 2 is a graph showing the characteristics of the apparatus.

Considering now the situation where the pressure in the conduit 45 is substantially equal to the pressure in the conduit 41. In this situation the piston 43 is substantially pressure balanced and the force exerted by the spring 44 will act on the piston 38 to partially balance the force exerted by the spring 40. As a result as the engine speed increases with the effective force of the spring 40 diminished, low speed advance will be achieved and this is shown in the continuous line in FIG. 2. When the piston 43 has moved its maximum extent, the spring 44 no longer is able to balance the force of the spring 40 and therefore the degree of advance will remain substantially constant until the pressure in the conduit 41 is able to move the piston 38 against the action of the springs 40. It will be appreciated of course that the pressure in the conduit 45 will be dependent upon speed and with intermediate settings of the valve member 24, different curves will be obtained, one such curve being indicated in chain dot in the graph.

With apparatus of the type so far described the reaction on the cam ring which occurs when the rollers engage the cam lobes must be prevented so far as is possible, from causing angular movement of the cam ring since this would disturb the setting of the cam ring. For this purpose the conduits 41 and 45 incorporate non-return valves 50, 51 respectively. The valves close when there is any tendency for the cam ring to be moved by the reaction. They can be arranged to define leakage paths to allow a low rate of flow in their blocking direction to permit movement of the pistons when the fluid pressures change. Alternatively the pistons 38 and 43 may define with the walls of their respective cylinders, small clearances defining leakage paths sufficient to allow a small fluid flow.

I claim:

1. A liquid fuel pumping apparatus for supplying fuel to internal combustion engines, the apparatus comprising a first piston slidable within a cylinder, means coupling said first piston to a component of an injection pump whereby movement of said piston will alter the timing of delivery of fuel by the injection pump, first resilient means biasing said first piston towards one end of the cylinder, conduit means through which the pressure of fuel delivered by a feed pump can be applied to said first piston to move said first piston against the action of the resilient means and in a direction to advance the timing of delivery of fuel, a second piston housed within a further cylinder, second resilient means urging said second piston in the direction to engage said first piston to assist the action of fuel pressure acting on the first piston, said fuel pressure also acting on one side of said second piston to oppose the force exerted by the second resilient means, a further conduit through which a control pressure can be applied to the other side of said second piston and valve means operable in conjunction with throttle means for generating said control pressure, said valve means being arranged so that said control pressure is substantially equal to the output pressure of the feed pump when said throttle means is set to provide a low quantity of fuel and is substantially zero when the throttle means is set to provide a high quantity of fuel.

2. The apparatus as claimed in claim 1 in which said first resilient means exerts a higher force on said first piston than said second resilient means exerts on said second piston.

3. The apparatus as claimed in claim 1 in which said valve means is arranged so that the control pressure varies between substantially zero and the output pressure of the feed pump and the throttle means is moved between the positions in which a low and a high quantity of fuel is supplied by the apparatus.

4. The apparatus as claimed in claim 3 including non-return valves disposed in said conduits respectively, said non-return valves being positioned to permit fluid flow into the cylinders containing the pistons.

5. The apparatus as claimed in claim 4 in which the pistons and the walls of the respective cylinders define leakage paths.

6. The apparatus as claimed in claim 1 in which said valve means modifies the output pressure of the feed pump to provide said control pressure.

* * * * *